United States Patent [19]

Guerra et al.

[11] Patent Number: 4,865,189

[45] Date of Patent: Sep. 12, 1989

[54] DEVICE FOR STORAGE, MIXING, AND DISPENSING OF TWO DIFFERENT FLUIDS

[75] Inventors: Diane R. Guerra, Weatherford; Michael J. Kent, Fort Worth; Don A. Clements, Arlington, all of Tex.

[73] Assignee: Alcon Laboratories, Inc., Fort Worth, Tex.

[21] Appl. No.: 235,412

[22] Filed: Aug. 24, 1988

[51] Int. Cl.[4] ..... B65D 1/04

[52] U.S. Cl. ..... 206/221

[58] Field of Search ..... 206/219, 221

[56] References Cited

U.S. PATENT DOCUMENTS

| | | | |
|---|---|---|---|
| 2,032,559 | 3/1936 | Barton . | |
| 2,813,649 | 11/1957 | Lipari | 206/221 X |
| 3,070,094 | 12/1962 | Sarnoff et al. . | |
| 3,330,280 | 7/1967 | Ogle . | |
| 3,439,823 | 4/1969 | Morane | 206/221 |
| 3,835,855 | 9/1974 | Barr, Jr. | 128/218 M |
| 3,924,741 | 12/1975 | Kachur et al. | 206/221 |
| 4,267,925 | 5/1981 | Crankshaw et al. | 206/221 |
| 4,331,233 | 5/1982 | Braymer, Jr. | 206/221 |
| 4,386,696 | 6/1983 | Goncalves | 206/221 |
| 4,550,825 | 11/1985 | Sutryn et al. | 206/222 |
| 4,563,186 | 1/1986 | Flynn et al. | 8/137 |
| 4,657,534 | 4/1987 | Beck et al. | 604/90 |
| 4,727,985 | 3/1988 | McNeirney et al. | 206/221 |
| 4,784,259 | 11/1988 | Grabenkort | 206/221 |

FOREIGN PATENT DOCUMENTS

| | | | |
|---|---|---|---|
| 1201070 | 7/1959 | France | 206/221 |

*Primary Examiner*—William Price

*Attorney, Agent, or Firm*—James Arno; Gregg C. Brown

[57] ABSTRACT

A device for storage, mixing, and dispensing of two separate materials, including but not limited to liquids, semi-liquids, powders, and granulated materials. The first and second containers include neck portions which are matably slidable within one another, the necks defining openings into each container. A plug member is retentively held in the neck of either container, and extends to a stopper portion which blocks fluid flow through the neck of the one container when it is positioned in the neck of the other container, thus separating the two independent materials during storage. A sleeve extends over the second container and at least a portion of the first container. A removable collar can be positioned between the second container and the first container to hold them in a position where the materials are separated for storage. By removal of the collar, the second container can be moved with respect to the first which moves the stopper portion out of the sealing position and allows communication between the containers for mixing. The second container can also include an opening sealingly closed by a second plug which allows a needle, cannula or other conduit to be inserted therethrough to withdraw the mixed fluids for dispensing.

25 Claims, 4 Drawing Sheets

DEVICE FOR STORAGE, MIXING, AND DISPENSING OF TWO DIFFERENT FLUIDS

BACKGROUND OF THE INVENTION

1. Field of the Invention

The present invention relates to a fluid container, and in particular, to a device for reliable storage, mixing, and dispensing of two different fluids or a fluid and a powder.

2. Problems in the Art

There are a number of times where two different fluids are required to be mixed into a formulation and then subsequently utilized. If the mixture does not need to be exact, conventionally, each separate fluid is stored in an independent container, and mixing is accomplished by approximating the quantities of each fluid to be mixed together.

However, there are many applications where the mixture must be very exact. An example is in the medical field whereby two different fluids must be stored separately, but then be able to be quickly and easily mixed in exact proportions, and then available for dispensing.

One way to accomplish this is to store the two separate containers, each being of the appropriate size to hold the exact amount of each fluid needed for the desired formulation. In assembly of transfer tubes, canulas, and other equipment that would be used to transfer one fluid into the container of the other, or transfer both fluids out of their containers into a third container. Such a procedure is cumbersome, subject to error, requires substantial amount of time, and extra equipment and materials. Additionally, especially in situations such as medical applications, the risk of contamination is increased.

There have been some attempts to remedy this problem by combining the exact quantities of the two fluids into one device for storage, mixing, and dispensing. However, these attempts are still deficient in a number of respects. Many are unreliable because they do not adequately prevent accidental mixing during handling and storage. Additionally, some of these devices do not sufficiently prevent against inadvertent dispensing of the fluids, either mixed or unmixed. Others are problematic in that they require somewhat complex structure and method steps to mix or dispense fluids, and some are simply complex in their structure and operation so as to make them expensive to manufacture and difficult to utilize.

Additionally, it would be advantageous to have a device which would allow a user to easily and immediately be able to discern, upon visual inspection of the device, whether it had been tampered with, whether the device has been put in a mixing mode, and whether mixing is complete. These features would enhance the reliability and safety of the device.

There are also many situations where sterility is needed. The aseptic condition of the container is particularly important in medical applications. Problems in the art exist with respect to achieving this desirable goal. While some can maintain aseptic conditions during storage, mixing, or dispensing, the art is deficient in providing this capability through all stages, including the filling of the two different fluids into the device.

An additional need in some instances involves screening or filtering particulate matter, or other contaminating matter from the mixed fluid as it is dispensed. This need is particularly important in some medical situations whereby the absence of particulate matter must be assured in the dispensed formulation. As can be appreciated, this is particularly important in ophthalmological formulations which are administered to a person's eye.

It is to be understood that similar problems exist with the storage, mixing, and dispensing of a fluid and a powder.

There is therefore a real need in the art for a device which allows for storage, mixing, and dispensing of two different fluids or a fluid and a powder with all the advantageous properties associated therewith.

It is therefore a principal object of the present invention to provide a device for storage, mixing and dispensing of two different fluids or a fluid and a powder which improves over or solves the deficiencies and problems in the art.

Another object of the present invention is to provide a device as above described which in one unitary structure accomplish these goals.

Another object of the present invention is to provide a device as above described, which securely stores two independent fluids or a fluid and a powder, in precise quantities, but which can easily be operated to achieve mixing and dispensing of the mixed fluid.

Another object of the present invention is to provide a device as above described, which is reliable in storage, mixing, and dispensing, and prevents accidental or inadvertent mixing or dispensing.

Another object of the present invention is to provide a device as above described, which is mechanically non-complex, and easy to manufacture, assemble, and operate.

A further object of the present invention is to provide a device as above described, which allows maintenance of aseptic conditions during filling, storage, mixing and dispensing.

Another object of the present invention is to provide a device as above described, which provides safety mechanisms to prevent unintentional mixing and dispensing, and provides visual indication of whether any tampering has occurred, or whether any mixing has occurred.

Another object of the present invention is to provide a device as above described, which is efficient, durable, and economical.

These and other objects, features, and advantages of the present invention will become more apparent with reference to the accompanying specification and drawings.

SUMMARY OF THE INVENTION

The present invention is a device for storage, mixing, and dispensing of two different fluids. It is to be understood that although the invention will be described with respect to being used with two different fluids, one of the fluids could be substituted by a powder. A first and second fluid holding container each have a neck portion defining an opening into respective fluid holding compartments. In assembly, the neck of the second container is slidably positioned within the neck of the first container. A plug assembly is retentively mounted, integrated, or frictionally fit in the neck of the second container and extends outside of that neck to a stopper or sealing portion which is of sufficient material, and shape, to seal against the interior of the neck of the first container. In that position, fluid contained in the first container cannot pass out of the neck of the first container, and fluid in the second container cannot pass into the first container and mix with its contents.

Coaxial movement of the two containers toward one another, however, would result in the sealing or stop portion of the plug member in the neck of the second container to move out of the neck of the first container and into the first container fluid holding chamber. The passageway exists through the portion of the plug means retentively held or otherwise positioned in the neck of the second container to allow fluid from the second container to communicate with fluid in the first container, when the containers are in this position.

One of the containers can then include an aperture sealed by an access or second plug. By utilizing appropriate means, the mixed fluid can then be withdrawn through that aperture or second plug. One conventional way is to utilize a needle or cannula inserted through the second plug to draw out the mixed fluid. As another example, the invention can be used with irrigation or intravenous (IV) sets in medical applications. In one embodiment of the invention, an overcap assembly, including a sleeve and overcap are included which cover the second container and at least a portion of the neck of the first container. The overcap would also cover the aperture and second plug in the second container to prevent inadvertent or premature access to the interior of the device before mixing has occurred. The sleeve and overcap would also function to provide a stop or end limit means to define the extent to which the neck of the second container can travel down into and through the neck of the first container. The sleeve and overcap also operate to prevent inadvertent mixing of the fluids. A removable collar or other intermediate member can be positioned between the sleeve and the first container to prohibit travel of the second container with respect to the first. Once the collar is removed, travel is allowed and mixing can occur. Removal of the collar signals that the device is in the mixing mode. In a still further embodiment, once the second container has been moved relative to the first to allow mixing, means are utilized to hold the second container in that position. This would allow a visual indication that mixing has occurred.

Furthermore, a removeable insert disc in the overcap can be ejected upon moving the containers to a mixing mode, also giving a visual indication of mixing. Moreover, the containers can be transparent enough to visually confirm that the plug member is moved to the mixing position.

It can therefore be seen that the present invention presents a device which is non-complex in structure, is easy to operate and is safe and reliable for storage, mixing and dispensing of two different fluids.

DETAILED DESCRIPTION OF THE PREFERRED EMBODIMENTS

With reference to the drawings, the preferred embodiments of the invention will now be described. It is to be understood that the preferred embodiments are set forth for purposes of example only to depict specific ways in which the invention can be embodied.

The invention represents a means for reliably storing exact quantities of two different and segregated fluids, in exact quantities, and then allowing reliable, easy, and accurate mixing of the two fluids. The preferred embodiment will be described with respect to mixing, storage, and dispensing of two fluids. However, the invention is equally applicable to mixing, storage and dispensing a fluid and a powder, as can be understood by those of ordinary skill in the art.

Figure 1:
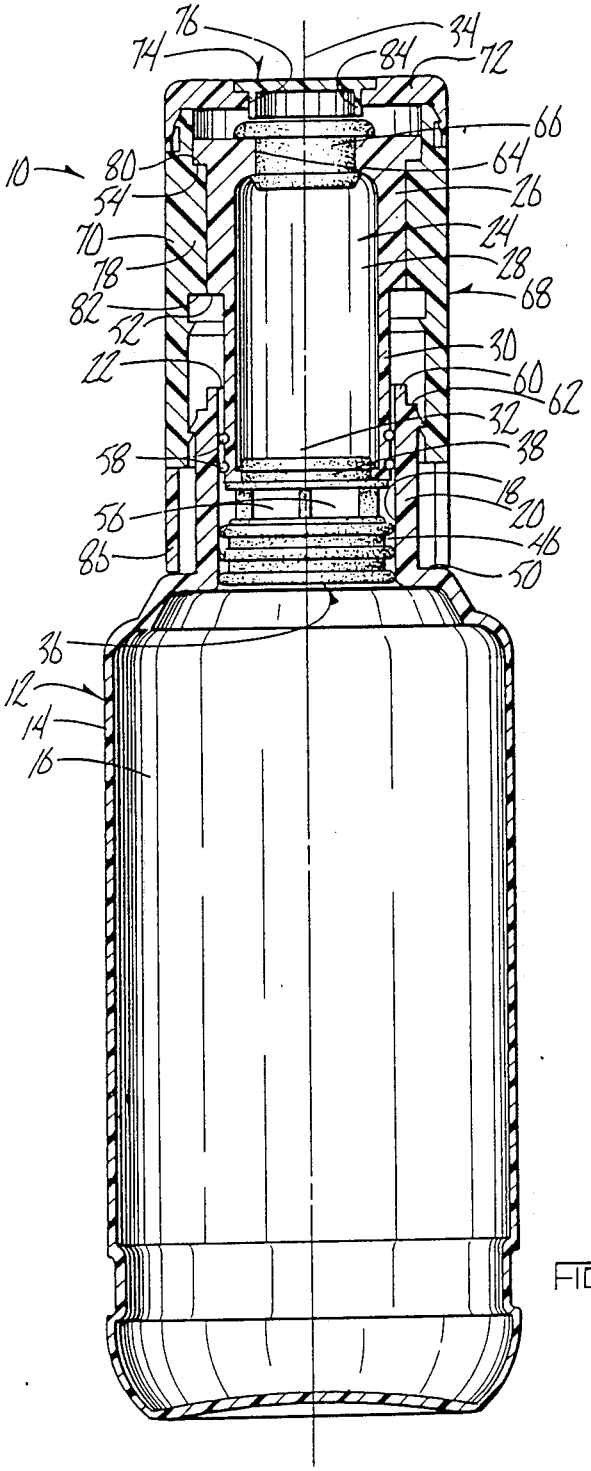
FIG. 1 is a sectional elevational view of one embodiment of the invention in assembled form for storage.

A first preferred embodiment of the invention is depicted in cross-section in FIG. 1. This first embodiment will be referred to generally by reference numeral 10. A first fluid holding container 12 includes a body 14, which defines a chamber 16 for holding a first fluid. An aperture 18 exists in the upper end of body 14. A neck 20 surrounds aperture 18 and extends outwardly or distally from body 14, and terminates in open end 22.

A second fluid holding container 24, inverted with respect to first container 12, has a body 26, second fluid holding chamber 28, and a neck 30 terminating in open end 32. As can be seen in FIG. 1, neck 30 is of a diameter slightly less than the inside diameter of neck 20 of first container 12, and matably is slidable in neck 20 of first container 12. First and second containers 12 and 24 thus are translatably movable towards and away from one another along longitudinal axis designated by line 34.

Stopper member 36, in the preferred embodiment of FIG. 1, consists of three parts. A retaining portion 38 retentively fits in the open end 32 of second container 24. Alternatively, stopper member 36 can be frictionally inserted into neck 20 of first container 12. It is to be understood that retaining portion 38 has a hollow center 40 (shown in FIG. 3) which allows fluid to pass from chamber 28 of second container 24 outwardly of open end 32 of second container 24.

An extension portion 42 extends from retaining portion 38 distally of open end 32 of second container 24. Extension portion 42 consists of four evenly spaced apart legs 44 which extend to stopper portion 46. Stopper portion 46 consists of a sealing member which sealingly but slidably fits in neck 20 of first container 12, and prevents fluid from passing out of chamber 16 of first container 12 when in neck 20 of first container 12. Stopper portion 46 also prevents fluid from second container 24 from passing into chamber 16 of first container 12 when stopper portion 46 is in sealing position in neck 20 of first container 12. In the preferred embodiment, stopper portion 46 consists of at least three sealing rings 48 positioned in spaced apart relation around radially of longitudinal axis 34.

In the preferred embodiment, stopper member 36 is made of an elastomeric material suitable for removable retention in open end 32 of second container 24, and sealing manner in neck 20 of first container 12. It is to be understood that any movement of second container 24 with respect to first container 12 results in movement of stopper member 36. It can therefore be further understood that when second container 24 is moved proximally towards first container 12, from the position shown in FIG. 1, stopper portion 46 of plug member 36 would move first through aperture 18 of first container 12, and then into chamber 16 of first container 12. At the point where top sealing ring 48 of stopper portion 46 clears aperture 18 into chamber 16 of first container 12, fluid communication would exist between second container 24 and first container 12 through hollow center 40 of retaining portion 38 and extension portion 42.

It can therefore be seen that embodiment 10 can function as a storage means for two different fluids in the position shown in FIG. 1, but also function as a mixing container by coaxial movement of second fluid container 24 with respect to first container 12.

Additional structure of the embodiment 10 of FIG. 1 allows additional features for the invention. First container 12 has a shoulder 50 surrounding the junction of neck 20 and body 14. Second container 24 has two shoulders; a first shoulder 52 generally defining the junction between neck 30 and body 26 of second container 24, and a second shoulder 54 at the end of second container 24 opposite of open end 32. As can be seen in FIG. 1, second shoulder 54 is wider in diameter than first shoulder 52. It is to be understood that because second container 24 is inverted, fluid can be held in the entire cavity defined by chamber 28, neck 30, hollow 40, and voids 56 surrounding extension portion 42 of plug member 36. As can be further seen, O-rings 58 are retentively positioned on the outside of neck 30 of second container 24 near open end 32 to seal any leakage of fluid upwards between necks 30 and 20.

The upper end of neck 20 of first container 12 consists of a raised rim 60 which is aligned to receive in abutting engagement first shoulder 52 of second container 24. A lower rim 62 outside of raised rim 60, comprises the rest of the upper end of neck 20.

Second container 24 has a second aperture 64 at its end opposite open end 32. A second plug 66 of elastomeric material sealingly and retentively fits into second aperture 64. Second plug 66 serves to allow access to second container 24 to withdraw mixed first and second fluids from first embodiment 10.

In the preferred embodiment of FIG. 1, includes some other features which contribute to the reliability and accuracy of embodiment 10 for storage, mixing, and dispensing of two independent fluids. An overcap assembly 68 consisting of a generally tubular portion 70 which surrounds most if not all of second container 24, and a portion of neck 20 of first container 12. A cap 72 is secured to tubular portion 70 and covers the top end of inverted second container 24, including second plug 66 and second aperture 64. A pop-out insert 74 is removably retained with an aperture 76 in cap 72, and is aligned directly above second plug.

It can be seen that the interior of tubular portion 70 of overcap assembly 68 has inwardly extending annular portion 78 . having an upper shoulder 80 and a lower shoulder 82. Upper shoulder 80 abuts second shoulder 54 of second container 24 in the position shown in FIG. 1. It can be seen that pop-out insert 74 has a downwardly extending rim 84 which contacts second plug 66. The outer wall of portion 26 of second container 24 frictionally abutts against the inner wall of portion 78 of tubular portion 70 of overcap assembly 68. This allows container 24 to move in unison with overcap assembly 68 until sufficient force overcomes that frictional relationship.

FIG. 1 also shows that a collar 86 can be positioned between the lower edge of overcap assembly 68, and shoulder 50 of first container 12. Collar 86 can be frangeably or otherwise removably connected to overcap assembly 68 to allow it to essentially be an intermediate member between overcap assembly 68 and first container 12 to hold second container 24 in position shown in FIG. 1. Collar 86 can also be a separate piece. This facilitates reliable storage without significant risk of inadvertent or accidental mixing of the first and second fluids. As can be seen, and as later will be described in more detail, removal of collar 86 leaves a gap for overcap assembly 68 to travel downwardly which in turn allows movement of second container 24 and plug member 36 downwardly to achieve a mixing position for embodiment 10. Removal of pop-out insert 74 would then allow insertion of a needle or cannula through second plug 66 to withdraw the mixed formulation.

Figure 2:
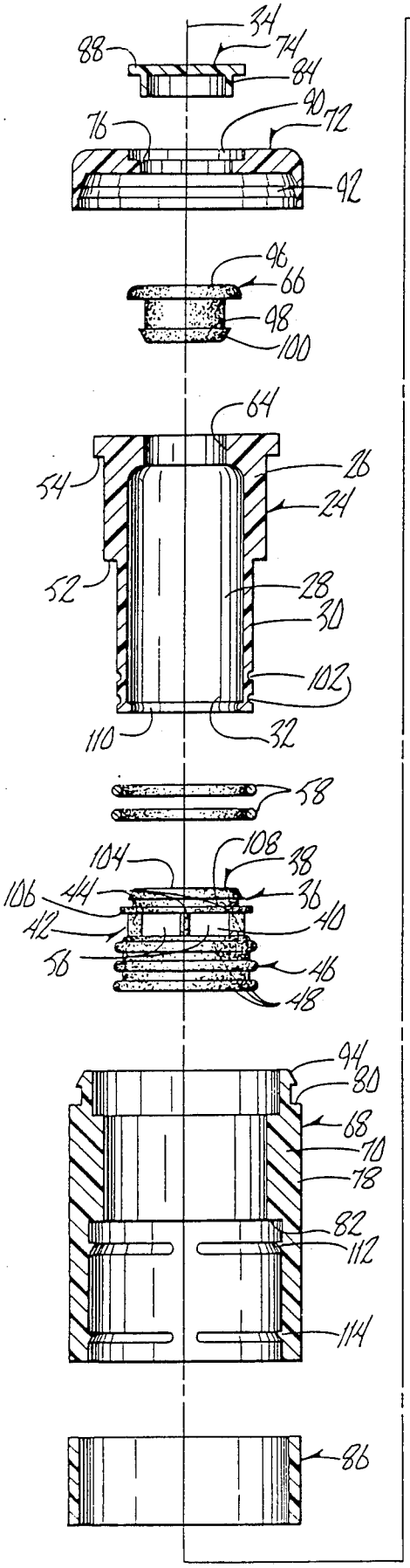
FIG. 2 is an exploded view of the embodiment of FIG. 1, with some parts being in cross-section.
Figure 2:
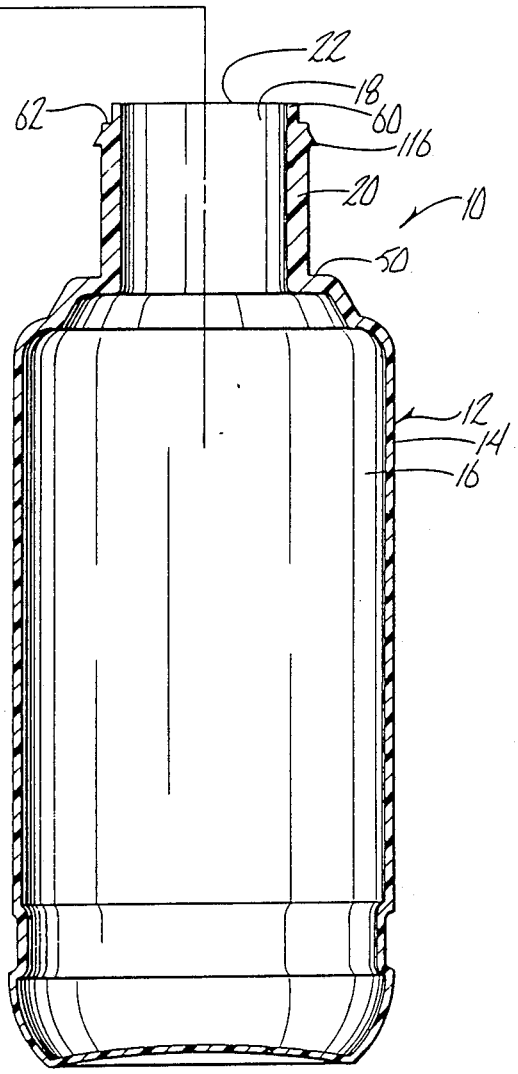

FIG. 2 depicts the parts of embodiment 10 of FIG. 1 in exploded form. It can be seen that top flange 88 of pop-out insert 74 fits within recess 90 in cap 72. Downwardly extending rim 84 of pop-out insert 74 is retained by interference fit within aperture 76 in cap 72 so that it is retentively held in that position.

It can also be seen that an internal wedge-shaped ring 92 is positioned inside of cap 72 cooperates with wedge-shaped ring 94 on the exterior of the top of tubular portion 70 so that cap 72 "snaps-on" to the top of tubular portion 70 and forms one unitary overcap assembly 68. It is again mentioned that collar 86 can be attached to tubular portion 70 in a manner that it can be easily broken away from tubular portion 70 or can be a separate piece. Collar 86 may or may not be shaped to extend around neck 20 of first container 12, but should be able to be easily removed from neck 20. In fact, collar 86 could be more in the form of a tab or blocking piece between overcap assembly 68 and first container 12.

Second plug 66 has a top flange 96 wider than aperture 64, and a lower flange 98 wider than aperture 64. Lower flange 98 has a beveled edge 100 to allow insertion into aperture 64, and then allow retention therein. It is to be understood that second plug 66 is solid yet elastomeric, to allow a needle or cannula to puncture and extend through it, and yet maintain sealing relationship with respect to second aperture 64. It can also be configured to allow operative connection to irrigation spikes or I.V. needles.

FIG. 2 also shows that the end of second container 24 near open end 32 includes two parallel annular grooves 102 which receive and retain O-rings 58.

Retaining portion 38 of plug member 36 also contains an upper beveled flange 104, and a lower flange 106, both of a larger diameter than middle section 108. This allows retaining portion 38 to retentively fit into open end 32 of second container 24, which includes inwardly extending flange 110.

In FIG. 2, it can also be seen that the interior of tubular portion 70 of overcap assembly 68 has two spaced apart and parallel wedge-shaped rings 112 and 114. Rings 112 and 114 are positioned below annular portion 78. Ring 114 serves to cooperate with wedge-shaped ring 116 at the top and exterior of neck 20 of first container 12 to define the limit of separation between second container 24 and first container 12. Ring 112 also cooperates with ring 116 on first container 12 to lock second container 24 into a mixing position with first container 12 when second container 24 is moved a sufficient distance towards first container 12. These functions will be described more specifically later in this description.

Figure 3:
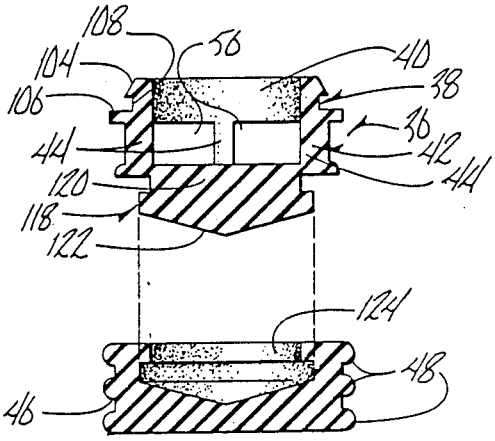
FIG. 3 is a disassembled cross-sectional elevational view of the stopper means of the embodiment of FIG. 2.

FIG. 3 shows in cross-sectional view a preferred embodiment of plug member 36 in disassembled form. It can be seen that retaining portion 38 and extension portion 42 are formed of one unitary piece 118, with the lower end of extension portion 42 consisting of an outwardly extending portion 120 which terminates in a head 122 wider than the diameter of outward portion 120. Stopper portion 46 includes a bore 124 which is roughly the same shape as outward portion 120 and head 122 of extension portion 42. The elastomeric nature of plug member 36 allows outward portion 120 and head 122 to interference fit into bore 124. It can be seen therefore that fluid from second container 24 can flow through hollow center 40, and between legs 44 of extension portion 42.

Figure 4:
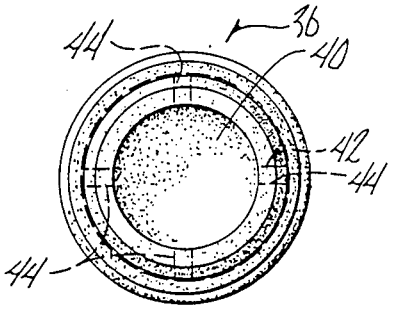
FIG. 4 is a top plan view of the upper portion of the stop means shown in FIG. 3.

FIG. 4 shows a top view of unitary piece 118 and in particular shows legs 44 of extension portion 42 and hollow center 40.

By reference to FIGS. 1, 5, 6, and 7, operation of embodiment 10 can be seen. In FIG. 1, collar 86 is in place. Therefore, overcap assembly 68 is held in a raised position, which in turn holds second container 24 in a raised position. Stopper portion 46 of plug member 36 is thus sealingly held in neck 20 of first container 12, and prohibits any exchange of fluids between second container 24 and first container 12. Collar 86 prohibits any downward movement of overcap assembly 68, whereas the abutment of wedge-shaped ring 116 on neck 20 of first container 12 with wedge-shaped ring 114 of the interior of tubular portion 70 of overcap assembly 68 prevents the sliding of overcap assembly 68 upwardly and away from neck 20 of first container 12.

Additionally, the abutment of second shoulder 54 of second container 24 with upper shoulder 80 of annular portion 78 of tubular portion 70 of overcap assembly 68, causes pop-out insert 74 to lightly abut second plug 66 to cover any access to second plug 66. The configuration of FIG. 1 therefore allows for reliable storage and separation of the first and second fluids which would be contained in embodiment 10. It also would allow a visual indication if any tampering had been done to embodiment 10 or if any accidental or non-intended mixing of the fluids had been attempted or accomplished.

Figure 5:
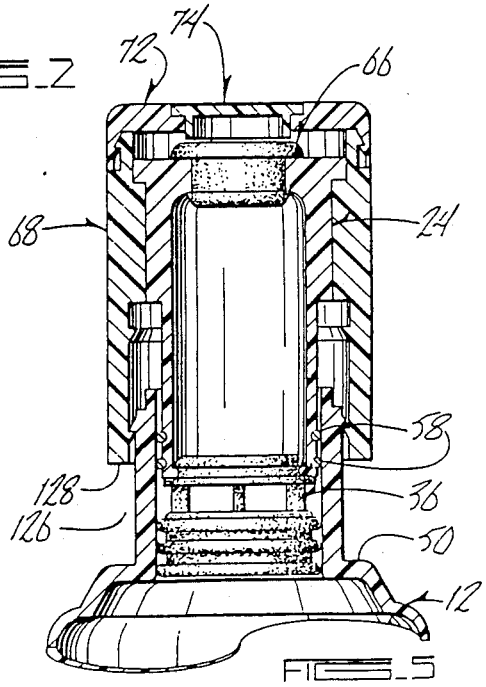
FIG. 5 is a cross-sectional elevational view of the embodiment of FIG. 1 with the collar means removed.

FIG. 5 shows the configuration of embodiment 10 with collar 86 removed. It can be seen that a gap 126 then exists between lower edge 128 of tubular portion 70 of overcap assembly 68 and shoulder 50 of first container 12. Embodiment 10 is thus in a state where it is ready to be converted to a mixing mode. The frictional sealing fit of stopper portion 46 in neck 20 of first container 12, however, holds second container 24 and overcap assembly 68 in the upward position until mixing is desired. Therefore, the invention continues to provide features for accurate and reliable use. Additionally, it is pointed out, that once collar 86 is removed, a user will be alerted to the fact that mixing may have occurred. It is also noted that in this position, as shown in FIG. 5, cap 72 and pop-out insert 74 are still in a position covering second plug 66 to prevent withdrawal of any fluid.

Figure 6:
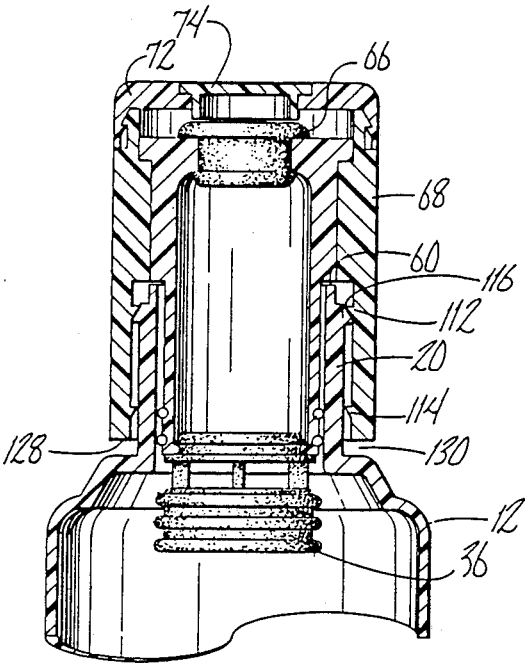
FIG. 6 is a cross-sectional view of the embodiment of FIG. 5 showing the device in a mixing mode.

FIG. 6 shows embodiment 10 in a mixing position. It can be seen that overcap assembly 68 has been manually pushed down to the point where rim 60 of neck 20 of first container 12 abuts first shoulder 52 of second container 24. This stops downward movement of second container 24, and it can be seen that stopper portion 46 of plug member 36 is free of neck 20 of first container 12, and extends into chamber 16 of first container 12. Fluid from second container 24 is thus free to flow through retaining portion 38 and extension portion 42 of plug member 36, into first container 12, or vice versa.

Overcap assembly 68 (and particularly insert 74) still covers second plug 66 to prevent withdrawal of any fluid. It is also to be understood that wedge-shaped ring 116 on neck 20 of first container 12 comes into abutment below wedge-shaped ring 112 on the interior of tubular portion 70 of overcap assembly 68 to bring overcap assembly 68 to an intermediate stopping point.

It is to be noted that a gap 130 still exists between lower edge 128 of overcap assembly 68, and shoulder 50 of first container 12.

Figure 7:
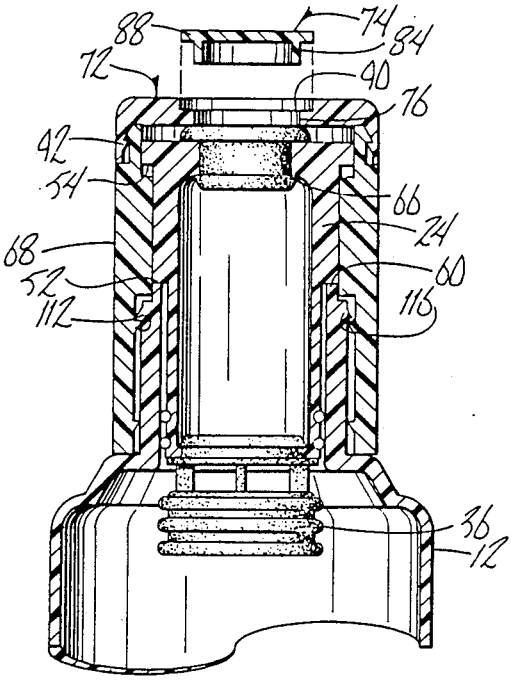
FIG. 7 is a cross-sectional elevational view of the device of FIG. 6 showing the device in a dispensing mode.

FIG. 7 depicts the final position of overcap assembly 68 to enable withdrawal of the mixed fluid from embodiment 10. Overcap assembly 68 is continued to be pushed downwardly from the position in FIG. 6. While any further movement of second container 24 is restrained by the abutment of rim 60 and first shoulder 52, tubular portion 70 can continue to travel downwardly until lower edge 128 abuts shoulder 50 of first container 12.

This movement would cause rim 84 of pop-out insert 74 to abut against the top flange 96 of second plug 66, and cause pop-out insert 74 to be moved upwardly in aperture 76. As shown in FIG. 7, pop-out insert 74 can be gripped by flange 88 and easily removed. A cannula or needle can then be inserted through elastomeric second plug 66 into chamber 28 of second fluid container 24, where by inverting embodiment 10, fluid will flow into second container 24 where it can be withdrawn.

It is to be understood that in the position in FIG. 7, overcap assembly 68 is retentively held by a snapping or locking of wedge-shaped ring 116 of first container 12 over wedge-shaped ring 112 of overcap assembly 68. By movement or gentle shaking, mixing of the two fluids can be completed. Thus, once put into the position of FIG. 7, the components of embodiment 10 are held in that position to allow quick visual identification that mixing has occurred and that embodiment 10 is in a dispensing mode. It is also to be understood that this locking also prevents inadvertent blockage of the fluid path from first container 12 into second container 24.

The locked cap 72 and insert 74 provide tamper-resistance and assures sterility of the product in at least second container 24. It also allows automatic "pop-up" operation of insert 74. This is the preferred construction. However, it is to be understood that in the configuration of embodiment 10, cap 72 can be in certain situations removed from overcap assembly 68, and second plug 66 can also be removed to gain access to second container 24. However, in this embodiment, the primary means of withdrawal of fluid from embodiment 10 is by insertion of a cannular needle through second plug 66. It can therefore be understood that embodiment 10 is easily disassemblable, and easy to operate; along with being easy to manufacture, assemble, and fill.

Figure 8:
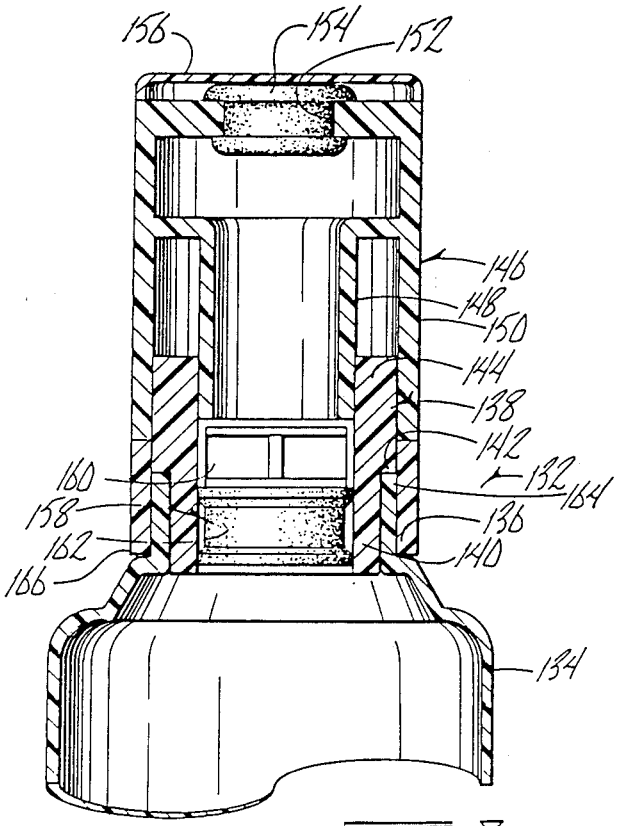
FIG. 8 is a cross-sectional elevational view of another embodiment of the invention.

FIG. 8 shows an alternative embodiment, which will be referred to as embodiment 132. Its operation is essentially similar to embodiment 10 shown in FIGS. 1 through 7, except for the following differences. Embodiment 132 utilizes a first fluid holding container 134 having a neck 136. A neck insert 138 has a lower portion 140 extending into neck 136, a shoulder 142 abutting the top of neck 136, and an upper portion 144 extending upwardly and outwardly from neck 136.

A second fluid holding container 146 includes a neck portion 148 which slidingly fits within neck 136 of first container 134. Second container 146 has integrally formed with it a sleeve portion 150 which fits over neck insert 138. Neck insert 138 thus is slidable between sleeve portion 150 and neck portion 148 of second container 146.

Second container 146 has an aperture 152 sealingly closed by plug 154. A cap 156 is removably mounted to cover plug 154. A plug member 158 has a first portion 160 attached to neck portion 148 of second container 146, and extends to a stopper portion 162. Plug member 158 functions similarly to plug member 36 of embodiment 10. Movement of second container 146 downwardly causes stopper portion 162 out of neck 136 of first container 134 and allows fluid from second container 146 to communicate with fluid in first container 134.

Embodiment 132 also utilizes a collar 164 which would be positioned between sleeve portion 150 and shoulder 166 of first container 134 to hold embodiment 132 in a storage position. Removal of collar 164 allows movement of second container 146 to a mixing position. Removal of cap 156 then allows withdrawal of the mixed fluid from embodiment 132.

Figure 9:
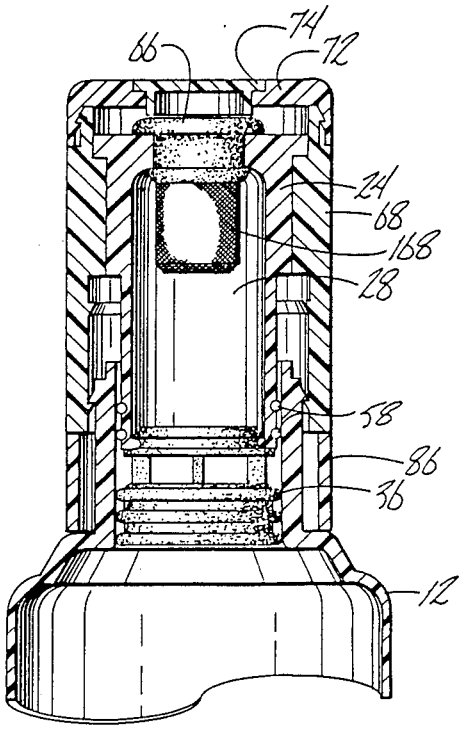
FIG. 9 is a cross-sectional elevational view of the embodiment of FIG. 1 shown with a filtering means.

FIG. 9 depicts an optional feature which can be used with any embodiment of the invention. A filter member 168 can be secured to second plug 66 of the embodiment 10 shown in FIG. 1. Filter 168 can comprise a basket shape with an open end covered by the lower end of second plug 66, and all other portions enclosed by a filter material such as a membrane or mesh. Such a configuration for filter 168 would allow a cannula or needle to be inserted through second plug 66 into the interior surrounded by the filter material, and allow filtering of particulate matter from the mixed formulation before withdrawal out of second plug 66.

It is to be understood that other types of filters and filter means could be utilized. For example, a filter could extend across the upper portion of second container 24. It is also to be understood that in the preferred embodiment, filter 168 is made of a material which is not either penetrable by a needle or cannula, or preferably the shape and location of the filter is such to disallow penetration by a cannula, needle, irrigtion spike or I.V. needle to insure the reliability of the filtering.

Figure 10:
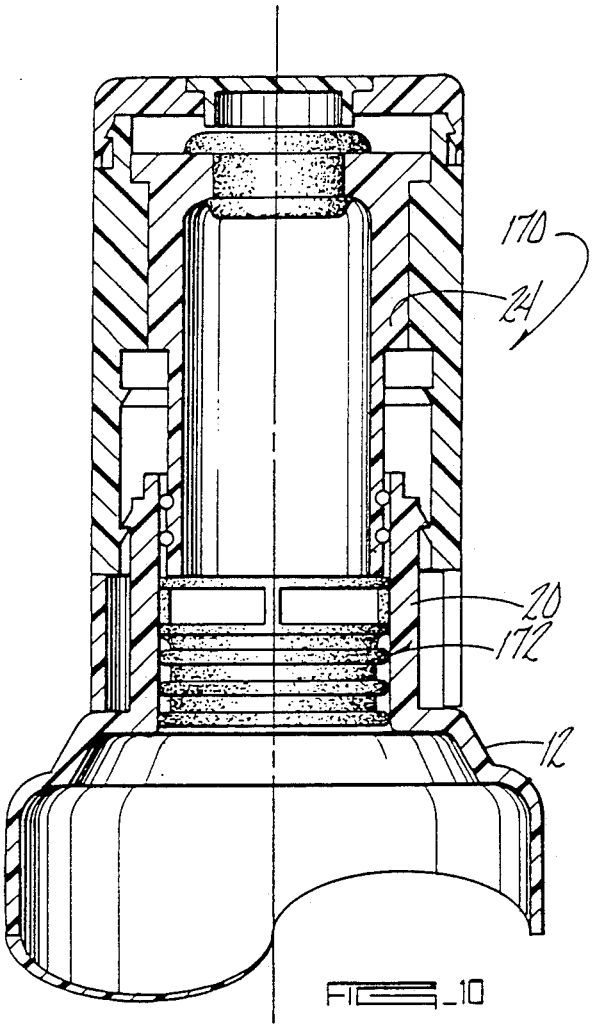
FIGS. 10 and 11 show in cross-section an alternative embodiment of the stopper plug for the invention.
Figure 11:
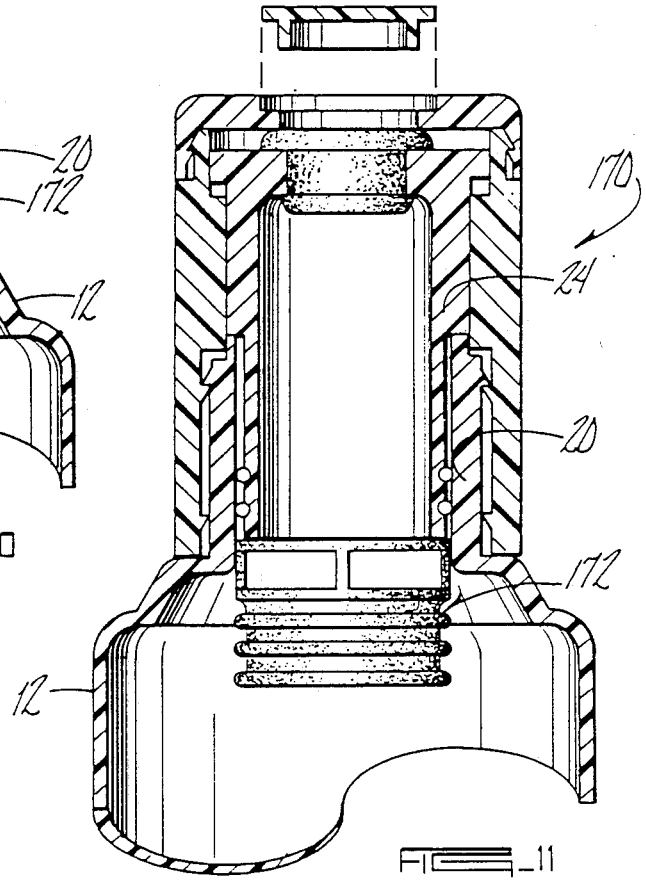

FIGS. 10 and 11 show an embodiment 170 which operate essentially the same as previously described embodiments (particularly embodiment 10). The primary difference is that plug stopper member 172 is not attached to or retentively held in second container 24. Rather it is wedged or frictionally held in position in neck 20 of first container 12 by its resilient elastomeric properties. In FIG. 10 it thus seals off any fluid communication between second and first containers 24 and 12. In FIG. 11, it can be seen it allows such fluid communication, but is still frictionally held in neck 20 and does not drop into first container 12. This alternative embodiment allows somewhat more flexible and easier manufacturing, component molding, and assembly.

It will be appreciated that the present invention can take many forms and embodiments. The true essence and spirit of this invention are defined in the appended claims, and it is not intended that the embodiments of this invention presented herein should limit the scope thereof. It can be seen that the invention achieves at least all of its stated objectives.

What is claimed is:

1. A device for storage, mixing and dispensing of two different materials comprising:

a first container means including a first material holding chamber, a neck and an aperture extending through the neck, providing fluid access to the first material holding chamber;

first stopper means sealingly positionable in the neck of the first container means, said stopper means including a retention means, a sealing means which is sealingly and slidably positionable in the neck of the first container, and a spacer means extending between the retention means and the sealing means, the spacer means allowing either material to communicate therethrough, the stopper means being slideably moveable in the neck of the first container in response to movement of a second container means;

the second container means including second material holding chamber, a neck, and an aperture extending through the neck providing access to the second material holding chamber, said neck of the second container slidably movable within the neck of the first container;

overcap means surrounding the second container means and at least a portion of the neck of the first container means, said overcap means having a first open end, and a second end which is closed by cover means;

collar means removably positionable between the open end of the overcap means and the first container means so that removal of the collar means allows the overcap means to be moved against the second container means, to in turn move the second container means to slide the sealing means of the stopper means out of the neck of the first container means and allow material from the second container means to communicate with material from the first container means.

2. A device for storage, mixing and dispensing of two different pourable substances comprising:

first container means having a chamber for holding a first pourable substance and an aperture in communication with the chamber;

first neck means having a proximal end positioned around the aperture of the first container means, a distal end, and a passageway between the proximal and distal ends for communication with the chamber of the first container means;

second container means having a chamber for holding a second pourable substance and an aperture in communication with the chamber;

second neck means having a proximal end positioned around the aperture of the second container means, a distal end, and an aperture, and including a passageway between the proximal and distal ends for communication with the chamber of the second container means, the second neck means being slidably movable within the first neck means between a first position wherein the distal ends of the first and second necks are in close relation, and a second position where the proximal ends of the first and second necks are closer to the distal ends of the first and second necks;

sealing means positioned between the first and second necks;

plug means including a retention means for releasing the plug means in the first neck, yet being movable within the first neck, extension means extruding from the retention means opposite from the distal end of the neck of the second container means and stopper means attached to the extension means;

in the first position, the stopper means sealingly preventing a substance passage through the neck of the first container means;

in the second position, the stopper means moving out of sealing position in the neck of the first container and into the chamber of the first chamber means to allow passage of substance between first and second container means.

3. A device for storage, mixing and dispensing of two different pourable substances comprising:

a first container including a body having a chamber for holding a first pourable substance, a tubular neck opening to the chamber, and a shoulder surrounding the junction of the neck to the body;

a second container including a body having a chamber for holding a second pourable substance, a tubular neck opening to the chamber, a first shoulder positioned exteriorally on the neck, and a second shoulder positioned exteriorally on the body;

plug means including a cover retentively fitted in the neck of the second container, and a stopper means held by legs in an extended position outside of the second container from the cover;

sleeve means including a hollow interior defined by an interior wall and a raised annular shoulder section extending inwardly from the interior wall, the sleeve means covering, at least partially, the second fluid container, and the raised annular shoulder abutting the second shoulder of the second container to hold the second container and stopper means in a retracted position;

removable intermediate means positioned between the sleeve means and the shoulder of the first container for holding the sleeve means and the second container in the retracted position so that the stopper means of the plug means seals any substance flow between the first and second container;

removal of the intermediate means allowing coaxial movement of the second container in the tubular neck of the first container to a compacted position whereby the stopper means of the plug means is moved out of the neck of the first container and allows communication between the first container and the second container.

4. The device of claim 3 wherein the neck of the second container being oppositely disposed to and slidably movable within the neck of the first container, the sleeve means surrounding at least a portion of and being slidably movable with respect to the necks of the first and second containers, said shoulder coming into abutment with the second shoulder of the second container when the second container is moved towards the first container.

5. A device for storage, mixing and dispensing of two different substances comprising:

first container means;

a first aperture allowing communication to the first container means;

second container means;

second aperture means allowing communication to the second container means;

plug means sealingly secured in the aperture of the second container means, said plug means including a cover means for covering the second aperture means, passage means in the cover means for allowing passage from inside the second container means to outside cover means, stopper means for sealing the first aperture means of the first container means, and extension means for holding the stopper means a spaced apart position from the cover means, said stopper means being slidable through the first aperture of the first container means so that when stopper means is in the aperture of the first container means, a substance is sealingly retained in the first container means and cannot mix with a substance in the second container means, but when the stopper means is slidably moved from the sealing position in the first aperture of the first container means to inside the fluid container means, the substance can pass through the passage means of the second container and through the extension means into the first container means.

6. A means for storage, mixing and dispensing of two separate materials comprising:

a first container having a neck defining an opening thereto;

a second container inverted with respect to the first container and having a neck defining an opening thereto, the neck of the second container slidably movable within the neck of the first container;

plug means retentively held within the neck of the second container by sealing retention means, and including a stopper portion extending outwardly from the neck of the second container having a sealing means for sealing passage of material through the neck of the first container, but being slidable within the neck of the first container, and including passage to allow material to pass from the second container to the exterior of the plug means;

sleeve means associated with, covering, and slidably movable with respect to the second container at least a portion of the exterior of the neck of the first container;

stop means for limiting the translatable movement of the neck of the second container into the neck of the first container so that the stop plug means is movable to a position where the stopper portion of the plug means moves out of a sealing relationship of the neck of the first container and allows material to communicate between the first and second containers through passage in the plug means so that the contents of the first and second containers can be mixed, and are available for dispensing.

7. The means of claim 6 further comprising a collar means removably positionable between the sleeve means and the first container disallowing movement of the stopper portion of the plug means out of sealing position and the neck of the first container.

8. The means of claim 7 wherein the collar means has a lower portion which abuts the shoulder on the first container and an upper portion which abuts the sleeve means when the collar means is in position on the means.

9. The means of claim 7 wherein the collar means is removable by a destructive force.

10. The means of claim 7 wherein the collar means is frangibly connected to the sleeve means.

11. The means of claim 6 wherein the plug means includes an extension means between the retention means and the stopper portion.

12. The means of claim 6 wherein the second container includes an aperture end opposite the neck, said aperture being sealingly blocked by a second plug means, said second plug means sealing material flow through the aperture for allowing a material conduit means to penetrate therethrough.

13. The means of claim 12 including a cap means removably mounted over the second plug means.

14. A device for storage, mixing and dispensing of two separate materials comprising:

a first container with a neck defining an opening into the container and having a shoulder on the exterior of the neck;

a second container with a neck defining an opening into the container and having a first shoulder on the exterior of the neck wider than the opening in the first container, and a second shoulder on the exterior of the container of wider width than the first shoulder and positioned towards the end of the second container opposite the opening of the second container;

plug means including a sealing retentive means retentively mounted in the neck of the first container, and including a material passage therethrough, extension means attached to sealing retentive means, and stopper means held in an extended position from the neck of the second container by the extension means, and being slidable through the neck of the first container, said stopper means prohibiting material flow through the neck of the first container when positioned in the neck of the first container;

means for holding the second container in a first position relative to the first container so that the stopper means is sealingly positioned in the neck of the first container, said means being removable as desired;

means for limiting movement of the second container relative to the first container to a second position where the stopper means is moved out of sealing position in the neck of the first container and material communication is established between the first and second containers.

15. The device of claim 14 further comprising a sleeve means having a first end surrounding at least a portion of the neck of the first container, and an opposite second end surrounding at least a portion of the second container.

16. The device of claim 15 further comprising a shoulder matably abuttable to the second shoulder of the second container, a second interior shoulder abuttable with the neck of the first container.

17. The device of claim 14 including means to retain the first and second containers in the second position.

18. The device of claim 14 including matable flanges on the interior of the sleeve to abut with the shoulder on the exterior of the neck of the first container.

19. The device of claim 14 further comprising an aperture in the second container opposite to the opening in the second container, the aperture being sealingly closed by a second plug means.

20. The device of claim 14 further comprising an overcap means positioned over the end of the second container means opposite the opening.

21. The device of claim 19 further comprising a filter means positioned within the second container means.

22. The device of claim 14 further comprising an insert means in the overcap means.

23. The device of claim 14 including means to hold a second container means in a third position.

24. The device of claim 14 wherein the two materials each comprise a fluid.

25. The device of claim 14 wherein the two materials are taken from the set comprising liquids, semi-liquids, powders, and granulated materials.

* * * * *